US008296902B1

(12) United States Patent
Adrian

(10) Patent No.: US 8,296,902 B1
(45) Date of Patent: Oct. 30, 2012

(54) SELF-ALIGNING DOOR STOP

(76) Inventor: David L. Adrian, Anaheim, CA (US)

( * ) Notice: Subject to any disclaimer, the term of this patent is extended or adjusted under 35 U.S.C. 154(b) by 478 days.

(21) Appl. No.: 12/590,826

(22) Filed: Nov. 16, 2009

(51) Int. Cl.
*E05D 5/00* (2006.01)

(52) U.S. Cl. ..... 16/86 R; 292/343; 292/DIG. 15

(58) Field of Classification Search ..... 16/82, 85, 16/86 R, 86 A; 292/342, 343, DIG. 15; D8/402
See application file for complete search history.

(56) References Cited

U.S. PATENT DOCUMENTS

| | | | | | |
|---|---|---|---|---|---|
| 1,983,784 | A | * | 12/1934 | Watkins et al. | 16/85 |
| 2,796,280 | A | * | 6/1957 | Ponder | 292/343 |
| D253,335 | S | * | 11/1979 | Gauntner et al. | D8/402 |
| 4,230,353 | A | | 10/1980 | Bjorgum | |
| 4,611,429 | A | * | 9/1986 | Kanies | 49/70 |
| 5,368,349 | A | | 11/1994 | Helbert et al. | |
| 5,711,560 | A | | 1/1998 | Gilbertson | |
| D455,952 | S | | 4/2002 | Gauci | |
| 7,014,229 | B1 | | 3/2006 | Stelmach | |
| D556,034 | S | | 11/2007 | Lee | |
| 7,644,964 | B2 | * | 1/2010 | Bushey et al. | 292/342 |
| 2007/0192989 | A1 | * | 8/2007 | Farzan | 16/82 |

* cited by examiner

*Primary Examiner* — William L. Miller
(74) *Attorney, Agent, or Firm* — Gordon K. Anderson

(57) ABSTRACT

A self-aligning door stop is taught that consists of a resilient cone shaped body having an apex, a rebated base with a major diameter selected to exceed spacing between a door and a floor upon which the door moves. The rebated base is configured to permit the door stop body to roll into a horizontal position when dropped in proximity of the door. When the door stop is on the floor in any orientation and the door is opened the door stop automatically rolls in the space between the door and the floor thereby self-aligning the door stop. Increasing the door movement retains the door in the desired open position.

19 Claims, 3 Drawing Sheets

SELF-ALIGNING DOOR STOP

TECHNICAL FIELD

The present invention relates to door stops in general. More specifically to a cone shaped door stop with a rebated base capable of gripping the space between a door and the floor without specifically inserting the door stop by hand in the space.

BACKGROUND OF THE INVENTION

Previously, many types of door stops have been used in endeavoring to provide an effective means to hold back a hinged door in the open position particularly the doors that incorporate door closing devices.

The prior art listed below did not disclose patents that possess any of the novelty of the instant invention; however the following U.S. patents are considered related:

| Pat. No. | Inventor | Issue Date |
|---|---|---|
| 4,230,353 | Bjorgum | Oct. 28, 1980 |
| 5,368,349 | Hebert et al. | Nov. 29, 1994 |
| 5,711,560 | Gilbertson | Jan. 27, 1998 |
| D455,952 S | Gauci | Apr. 23, 2002 |
| 7,014,229 B1 | Stelmach | Mar. 21, 2006 |
| D556,034 S | Lee | Nov. 27, 2007 |

Bjorgum in U.S. Pat. No. 4,230,353 teaches a stop for doors which open into rooms having a solid carpet which consists of a handle, a base member and downwardly extending projections angulated such that they slant away from the door. When place in proximate relation to the door, unauthorized opening is prevented to the extent that entry into that room is impossible without damaging the door.

U.S. Pat. No. 5,368,349 issued to Hebert et al. provides a door stop assembly for introduction into the space between the door and floor. The wedge shaped block has a top and bottom surface oriented toward each other at an acute angle. A flat strip of spring steel is bent at an acute angle and secured to the bottom of the wedge shaped block. The top leg of the spring has a concave curvature to maintain contact with the bottom of the door. There is also structure secured to the bottom of the block preventing sliding on the support surface adjacent to the bottom edge of the door.

Gilbertson in U.S. Pat. No. 5,711,560 discloses a security wedge used in connection with door retention to prevent opening. The wedge member has a number of retainer projections insertable into carpeting after the wedge has been placed under the door with the door closed so that wedge is prevented from slipping and the door cannot be opened unless it is broken down. A rubber cap may be placed on the bottom of the wedge for use on hard surface floors.

Gauci in U.S. design patent D455,952 S teaches a hollow door stop having a truncated cone shape with a series of six ribs adjacent to the smaller end.

U.S. Pat. No. 7,014,229 B1 issued to Stelmach is for a combined door stop and holder which includes a wedge shaped stop member connected to a tether which is in turn attached to a hollow receptacle with the rear face attached to a door. The front face is provided with a receptacle dimensioned to receive the tether and forms a bumper member which projects outwardly from the front face.

Lee in U.S. design patent D556,034 S discloses a door stop in a basically tapered cylindrical shape with a round ball shaped distal end and three raised ribs distending to the larger proximal end.

BRIEF SUMMARY OF THE INVENTION

Hinged doors have always the propensity to swing closed under certain conditions with wind and pressure differentials within a dwelling or commercial building which is inconvenient and bothersome. This problem is particularly present in doors that utilize mechanical of hydraulic door closures which are used almost universally in commercial buildings, particularly where air conditioning is employed. The usual method of blocking the door in an open position is by the use of a wedge shaped door stop which is made of a resilient material, or in its uncomplicated form, a simple piece of wood having a wedge configuration. The principal of compressing a wedge between the bottom edge of the door and the floor underneath is simple and straightforward and accomplishes the task at hand with ease, however it requires a person to physically bend down and place the stopper at the proper position and either force the wedge in place or manually pull the door open over the stop.

It is therefore a primary object of the invention to simplify the task by dropping the door stop near the edge of the door opposite the hinge without stooping and pulling the door open slightly. This object is accomplished by instead of using a conventional rectangular wedge shape stop the invention utilizes a cone shaped member that is rebated on the large end. This unique and novel cone shaped body employs the principle that when the door is pulled adjacent to the device the pointed end of the cone is automatically forced under the door by the mere rotational movement of the door rolling the cone into a position with the small end arcuately forced inwardly under the door creating the wedging action. Since the invention does not require physically wedging the stop by hand under the door the invention is truly self-aligning only requiring dropping the stop adjacent to the door.

An important object of the invention is that there is no specific orientation required as when the door stop is dropped it may be rolled under the door in any position with the tapered end facing or opposing the door hinges. The rebated end of the invention permits the cone shaped door stop to always fall in a horizontal position. In the event that the door stop falls too far away from the door the user may simply nudge the door stop with his or her foot closer to the edge of the door and then may self align the stop under the door.

Another object of the invention is in the fact that the rolling action of the cone shape stop reduces door edge damage, as the invention is made of a resilient material, and only touches a small area of the bottom of the door, since it is round at the point of contact.

Still another object of the invention is that even though the cone shape permits self aligning it may also be used as a conventional stopper and may be manually set in place when desired.

Yet another object of the invention relates to the shape of the cone which permits the invention to be used with a variety of floor surfaces. The resilience of the material in which the invention is made also increases compatibility with smooth surfaces and creates no problems for rugs or carpets which are also easily adhered to as the surface of the cone shape grips the nap of the material without the need of sharp projections.

Almost all floor surfaces are easily used with the invention which include hardwood, smooth concrete, tile, linoleum, metal shavings and even water laden flooring.

Some prior art door stops require holding the stop in place while opening the door and others necessitate kicking or otherwise forcing the door to form a proper wedge. Therefore a further object of the invention eliminates this problem as the shape of the invention creates its own automatic positioning with no additional force required.

A further object of the invention is in the optional features of the invention which include different selected surfaces on the outside of the cone including a textured surface such as a plurality of minute protrusions creating a sandpaper like finish, knurling, a number of V-shaped grooves creating a spline and a helical flute with multiple grooves on the periphery of the cone.

Another optional feature of the invention is the use of attachments on the rebated base for connecting a lanyard or cord for use with tags, hangers, or retrieval devices. The distal end of the lanyard or cord may be attached to the door, metalwork, a knob or lever. The attachments include an eyebolt and integrally formed'nut, a metallic pin imbedded in the body, one or two integral eye members with an opening in the center for attachment and a sheet metal hasp formed within the body of the invention. The attachments provide personalizing by the attachment of a tag or hanger device for the purpose of warning, advertisement or identification. Other uses of the attachments include functions permitting a user to retrieve the invention from a standing position rather than having to bend over completely.

It is easily accomplished to apply indicia to the outside surface of the body by molding, etching, stenciling etc. on one or more sides for the purpose of identification or advertisement.

These and other objects and advantages of the present invention will become apparent from the subsequent detailed description of the preferred embodiment and the appended claims taken in conjunction with the accompanying drawings.

DETAILED DESCRIPTION OF THE INVENTION

Figure 1:
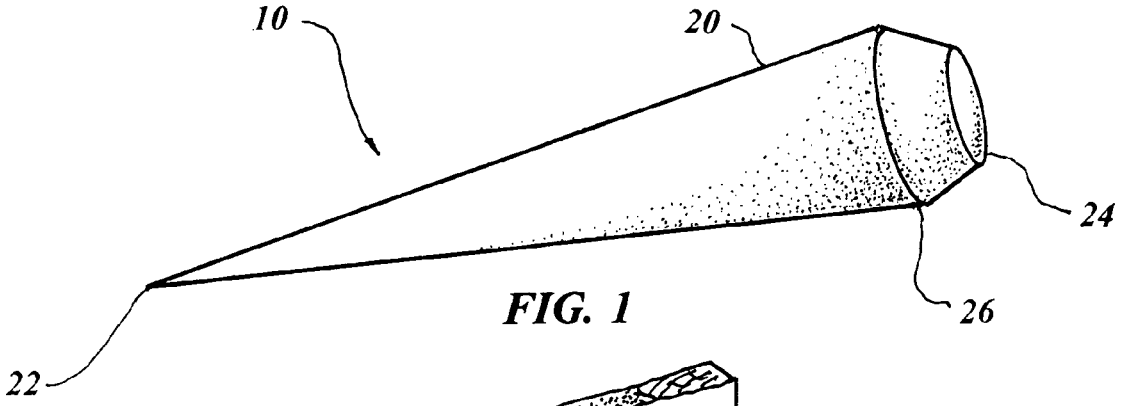
FIG. 1 is a partial isometric view of the self-aligning door stop in the preferred embodiment.
Figure 2:
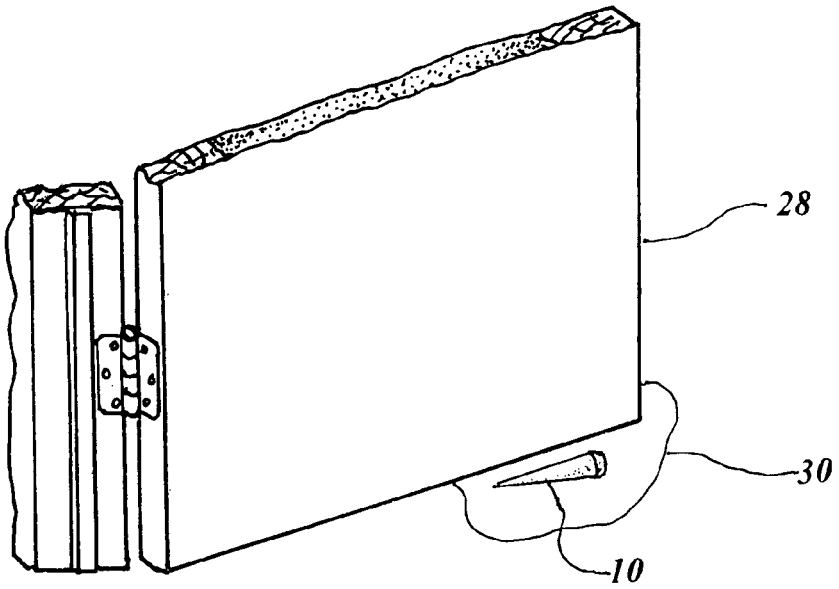
FIG. 2 is a partial isometric view of an open door and door jamb with the self-aligning door stop lying adjacent to the open door.
Figure 3:
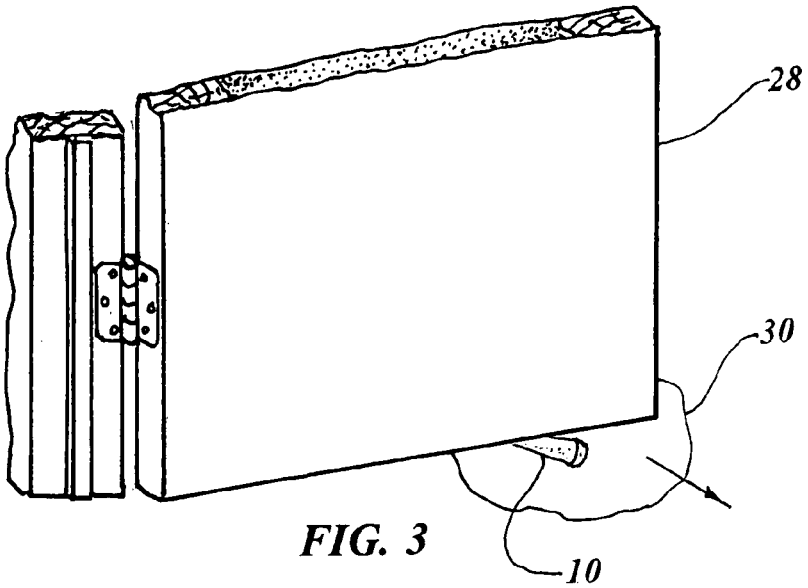
FIG. 3 is a partial isometric view of an open door and door jamb with the self-aligning door stop rolled between the bottom of the door and the floor by a user pulling the door in the direction of the arrow.
Figure 4:
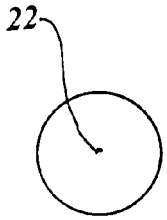
FIG. 4 is the apex end elevation view of the of the self-aligning door stop.

The best mode for carrying out the invention is presented in terms of a preferred embodiment, with optional features, of a self-aligning door stop 10. This preferred embodiment is shown in FIGS. 1 thorough 23 and is comprised of a cone shaped body 20 having an apex 22 and a rebated base 24 with the major diameter 26 of the body 20 selected to exceed spacing between a door 28 and a floor 30 upon which the door travels above. The apex 22 has a diameter less than a space between the door and the floor. Although the apex 22 is illustrated as a sharp point the apex 22 may be blunted slightly to preclude breaking.

Figure 5:
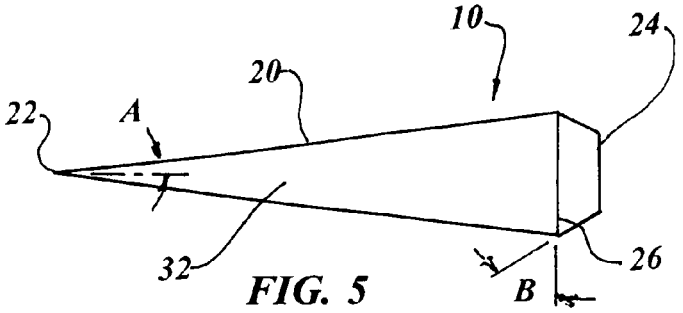
FIG. 5 is an elevation plan view of the self-aligning door stop in the preferred embodiment with appropriate angles illustrated with alpha letters.
Figure 6:
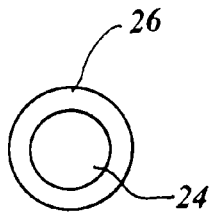
FIG. 6 is the rebated base end elevation view of the of the self-aligning door stop.

The cone shaped body 20 may be any dimensional size and still be within the scope of the invention, however it is preferred that the body 20 has an overall length of from 5.50 to 6.50 inches, a major diameter of from 1.25 inches to 1.50 inches and a diameter of the rebated base of from 0.88 inch to 1.00 inch, as illustrated in FIGS. 1 and 4 through 6. It is also preferred that the cone angle is from 6.0 to 8.0 degrees relative to an imaginary longitudinal centerline and the rebated base 24 angled from 25.0 to 27.0 degrees relative to an imaginary lateral centerline of the major diameter 26 as depicted in FIG. 5. FIG. 5 further illustrates the cone angle with the alpha letter "A" and the rebated base angle the alpha letter "B".

The body 20 formed of a resilient material such that when the body is compressed between the door 28 and the floor 30 the door 28 will not be able to move from a retained position. The resilient material may be any type suitable for the application, such as styrene butadiene (SBR), ethylene propylene, polyurethane, neoprene, butyl rubber, hollow thermoplastic or the like with styrene butadiene (SBR) being preferred. In any case the material would have a measure of hardness from 70 to 90 shore durometer with 80 shore durometer optimum.

It is anticipated that the cone shaped body 20 is formed by compression in a multi-cavity mold or other appropriate manufacturing technique.

The rebated base configuration permits the body 20 to roll into a horizontal position when dropped by a user in proximity of the door 28, such that it is unnecessary for the user to lean over and manually place the door stop 10 in the space between the door and the floor. When the door stop 10 is dropped in any orientation the user pulls the door 28 open slightly rolling the door stop 10 in the space between the door 28 and the floor 30 thereby self-aligning the door stop 10 utilizing the door 10 movement until the door stop 10 retains the door 28 in a desired retained position. If the door stop 10 falls away from the door 28 the user may simply nudge the door stop 10 with his or her foot closer to the edge of the door 28 allowing the door stop 10 to be in the proper position to self align.

Figure 7:
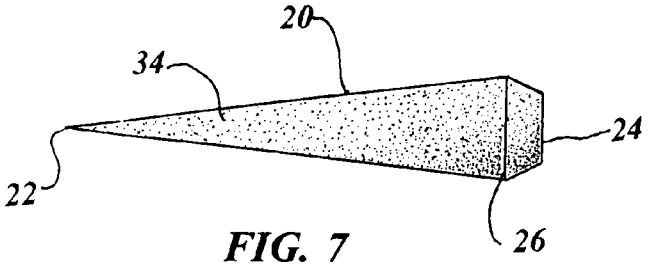
FIG. 7 is a partial isometric view of the self-aligning door stop with the textured outside surface.
Figure 8:
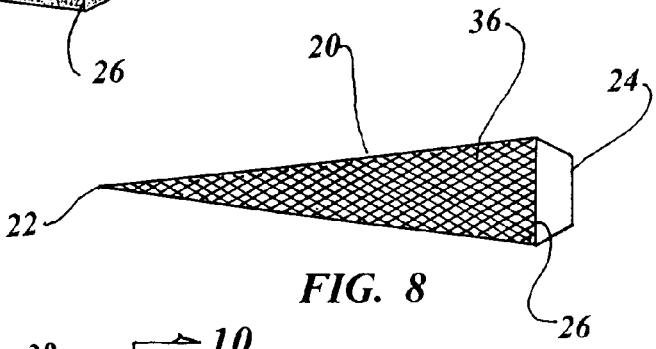
FIG. 8 is a partial isometric view of the self-aligning door stop with the knurled outside surface.
Figure 9:
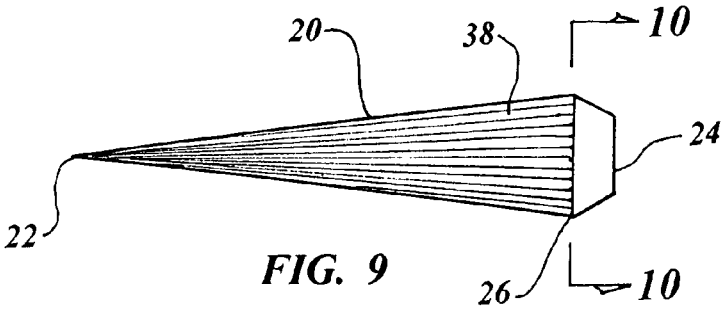
FIG. 9 is a partial isometric view of the self-aligning door stop with the V-groove spline outside surface.
Figure 10:
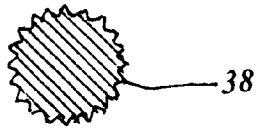
FIG. 10 is a cross sectional view taken along lines 10-10 of FIG. 9.

The cone shaped body 20 preferably has a plain smooth 32 outside surface as illustrated in FIGS. 1 through 6; however instead an optional irregular outside surface may be utilized which is outlined as follows:

The body irregular outside surface may be textured by having a plurality of minute protrusions on the surface thereby creating sandpaper like finish 34, as shown in FIG. 7. The surface may be knurled 36 as depicted in FIG. 8 or have multiple V-grooves spline configuration 38 as shown pictorially in FIGS. 9 and 10.

Figure 11:
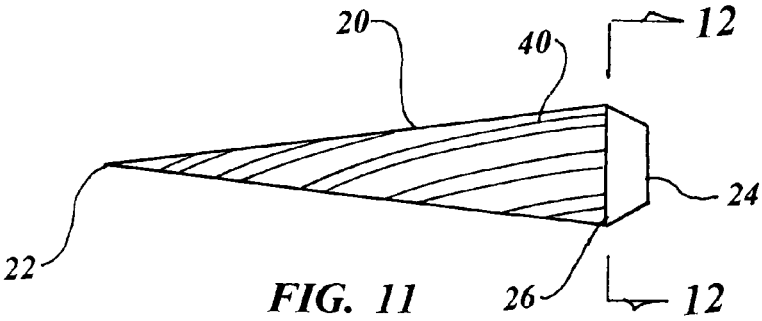
FIG. 11 is a partial isometric view of the self-aligning door stop with the helical flute outside surface.
Figure 12:
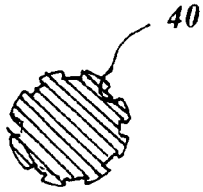
FIG. 12 is a cross sectional view taken along lines 12-12 of FIG. 11.

The body 20 irregular outside surface may incorporate a helical flute 40 configuration with square flutes or V-shaped grooves formed into the body in a spiral manner, as illustrated in FIGS. 11 and 12.

Other options may be provided with the self-aligning door stop 10, illustrated in FIGS. 13 through 23, which provide a method for connecting the door stop 10 to a lanyard or cord, (not illustrated as they are not part of the invention claimed).

Figure 13:
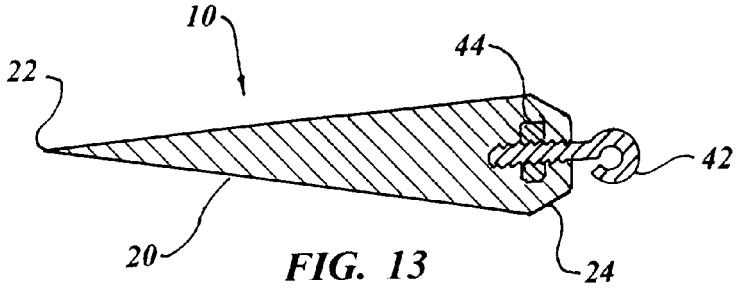
FIG. 13 is a cross sectional view of the attachment means in the self-aligning door stop in the form of an eyebolt attached to a nut formed within the door stop body.
Figure 14:
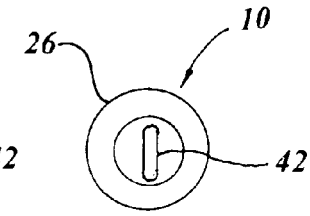
FIG. 14 is the rebated base end elevation view of the of the self-aligning door stop.

FIGS. 13 and 14 illustrate an eyebolt 42 attached to a nut 44 formed integral within the body 20.

Figure 15:
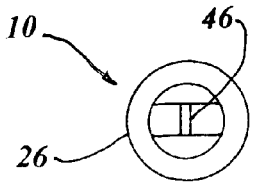
FIG. 15 is the rebated base end elevation view of the of the self-aligning door stop.
Figure 16:
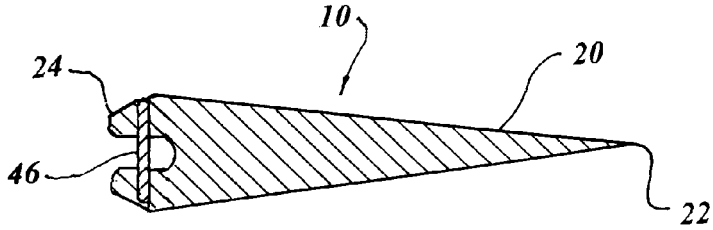
FIG. 16 is a cross sectional view of the attachment means in the self-aligning door stop in the form of an imbedded pin with in the door stop body.

FIGS. 15 and 16 illustrate a metallic pin 46 imbedded integrally within the body 20.

Figure 17:
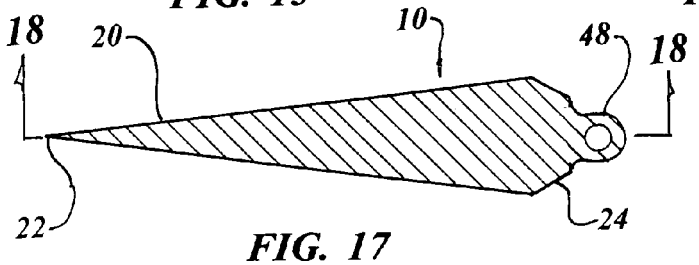
FIG. 17 is a cross sectional view of the attachment means in the self-aligning door stop in the form of a single eye formed integral with the door stop body.
Figure 18:
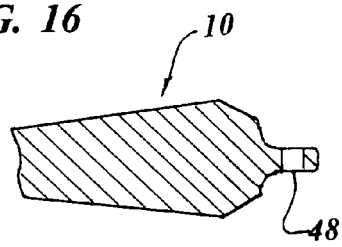
FIG. 18 is a fragmentary cross sectional view taken along lines 18-18 of FIG. 17.
Figure 19:
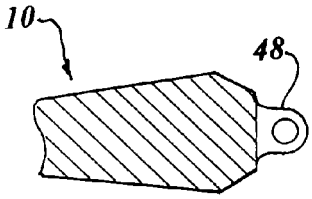
FIG. 19 is a fragmentary cross sectional view taken along lines 19-19 of FIG. 20.
Figure 20:
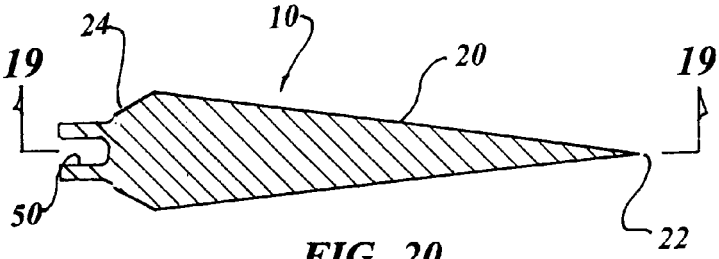
FIG. 20 is a cross sectional view of the attachment means in the self-aligning door stop in the form of two eyes formed into a yoke on the door stop body.

FIGS. 17 and 18 illustrate a single integral eye member 48 formed as part of the body creating a sole attachment point and FIGS. 19 and 20 show two eye members 48 separated apart forming a yoke 50.

Figure 21:
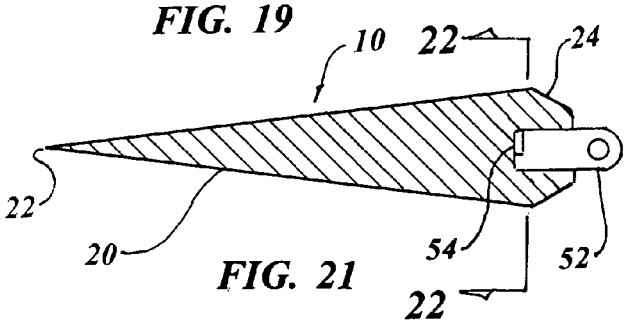
FIG. 21 is a cross sectional view of the attachment means in the self-aligning door stop in the form of formed sheet metal hasp imbedded in the door stop body.
Figure 22:
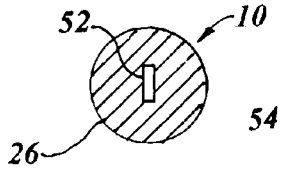
FIG. 22 is cross sectional view of the formed sheet metal hasp imbedded in the door stop body taken along lines 22-22 of FIG. 21.
Figure 23:
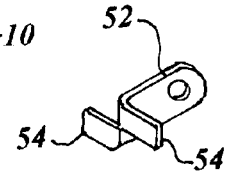
FIG. 23 is a partial isometric view of the sheet metal hasp with tabs bent outwardly for retention within the door stop body.

FIGS. 21 through 23 depict attachment means utilizing a formed sheet metal hasp 52 imbedded in the body 20. The hasp 52 may be cut in a steel rule die and formed with opposed legs 54 assuring that the hasp 52 is securely retained within the body 20.

It is anticipated that there may be other methods of attachment and still function in an acceptable manner.

In functional operation there is no specific orientation with either the apex 22 or the rebated base 24 pointing toward the hinge side of the door 28. Although it is not necessary, the invention functions best if the door stop 10 is positioned at the far end of the door 28 away from the hinge side.

When the door stop 10 is dropped or placed on the floor 30 near the door 28 the cone configuration allows the stop 10 to automatically rotate into the proper position by the leading edge of the door 28 and will continue to roll until the apex 22 is completely under the door where the underside leading edge of the door will intercept the stop 10 somewhere along its length depending upon the distance of the gap between the door 28 and the floor 30. Upon engagement the stop 10 will roll and gain greater resistance as the door 28 continues to move until the vertical force (wedge action) is greater than that the lateral force of the door 28 and the door 28 will be completely captivated.

While the invention has been described in complete detail and pictorially shown in the accompanying drawings, it is not to be limited to such details, since many changes and modifications may be made to the invention without departing from the spirit and scope thereof. Hence, it is described to cover any and all modifications and forms which may come within the language and scope of the appended claims.

The invention claimed is:

1. A self-aligning door stop which comprises, a resilient cone shaped body having an apex with a diameter less than a space between a door and a floor, and a rebated base with a major diameter selected to exceed spacing between the door and the floor upon which the door travels above, said rebated base permits the body to roll into a horizontal position when dropped in proximity of the door, such that it is unnecessary to manually place the door stop in the space between the door and the floor, therefore when the door stop is dropped in any orientation and the door is opened felling the door stop in rolls into the space between the door and the floor thereby self-aligning the door stop utilizing the door movement until the door stop makes contact between the door and the floor thereby compressing the body and retaining the door in a desired open position.

2. A self-aligning door stop which comprises, a cone shaped body having an apex and a rebated base having a major diameter selected to exceed spacing between a door and a floor upon which the door upon which the door travels above, and the apex having a diameter less than a space between the door and the floor, said body formed of a resilient material such that when the body is compressed between the door and the floor the door will not be able to move from a retained position, and said rebated base permits the body to roll into a horizontal position when dropped by a user in proximity of the door, such that it is unnecessary to manually place the door stop in the space between the door and the floor, therefore when the door stop is dropped in any orientation and the door is opened the door stop rolls into the space between the door and the floor thereby self-aligning the door stop utilizing the door movement until the door stop makes contact between the door and the floor thereby compressing the body and retaining the door in a desired open position, however when the door stop falls away from the door the door stop may be nudged closer to the edge of the door allowing the door stop to self align.

3. The self-aligning door stop as recited in claim 2 wherein said cone shaped body further having an overall length of from 5.50 to 6.50 inches, said major diameter of from 1.25 inches to 1.50 inches and a diameter of the rebated base of from 0.88 inch to 1.00 inch.

4. The self-aligning door stop as recited in claim 3 wherein said cone shaped body having a measure of hardness from 70 to 90 shore durometer.

5. The self-aligning door stop as recited in claim 2 wherein said cone shaped body further having a cone angle of from 6.0 to 11.0 degrees relative to an imaginary longitudinal centerline.

6. The self-aligning door stop as recited in claim 2 wherein said cone shaped body rebated base is angled from 25.0 to 27.0 degrees relative to an imaginary lateral centerline of the major diameter.

7. The self-aligning door stop as recited in claim 2 wherein said cone shaped body is formed from a material is selected from the group consisting of styrene butadiene (SBR), ethylene propylene, polyurethane, neoprene, butyl rubber and hollow thermoplastic.

8. The self-aligning door stop as recited in claim 2 wherein said cone shaped body is formed by compression in a mold.

9. The self-aligning door stop as recited in claim 2 wherein said cone shaped body further comprises a plain smooth outside surface.

10. The self-aligning door stop as recited in claim 2 wherein said cone shaped body further comprises an irregular outside surface.

11. The self-aligning door stop as recited in claim 10 wherein said cone shaped body irregular outside surface is textured.

12. The self-aligning door stop as recited in claim 10 wherein said cone shaped body irregular outside surface is knurled.

13. The self-aligning door stop as recited in claim 10 wherein said cone shaped body irregular outside surface having a multiple V-groove spline configuration.

14. The self-aligning door stop as recited in claim 10 wherein said cone shaped body irregular outside surface having a helical flute configuration.

15. The self-aligning door stop as recited in claim 2 wherein said cone shaped body further having attachment means for connecting the door stop to a lanyard or cord.

16. The self-aligning door stop as recited in claim 15 wherein said cone shaped body attachment means further comprises an eyebolt attached to a nut formed integral within the body.

17. The self-aligning door stop as recited in claim 15 wherein said cone shaped body attachment means further comprises a metallic pin imbedded integrally within the body.

18. The self-aligning door stop as recited in claim 15 wherein said cone shaped body attachment means further comprises at least one integral eye member formed integrally into the body forming a single attachment point with two eye members separated apart forming a yoke.

19. The self-aligning door stop as recited in claim 15 wherein said cone shaped body attachment means further comprises a formed sheet metal hasp imbedded in the body.

* * * * *